US006578728B1

(12) United States Patent
Weigen

(10) Patent No.: US 6,578,728 B1
(45) Date of Patent: Jun. 17, 2003

(54) MESSAGE DELIVERY APPARATUS AND SYSTEM FOR PAPER DISPENSERS AND SIMILAR DEVICES

(76) Inventor: Norman Weigen, 2000 Classic Dr., Coral Springs, FL (US) 33071

( * ) Notice: Subject to any disclaimer, the term of this patent is extended or adjusted under 35 U.S.C. 154(b) by 252 days.

(21) Appl. No.: 09/724,174

(22) Filed: Nov. 28, 2000

Related U.S. Application Data

(60) Provisional application No. 60/181,644, filed on Feb. 10, 2000.

(51) Int. Cl.[7] ..... G07F 11/00

(52) U.S. Cl. ..... 221/2; 221/3; 221/135; 312/34.8; 312/34.19

(58) Field of Search ..... 221/2, 3, 135; 312/34.8, 34.19; 101/5, 6, 7, 23

(56) References Cited

U.S. PATENT DOCUMENTS

| | | | | |
|---|---|---|---|---|
| 3,252,410 A | * | 5/1966 | Stephenson | |
| 3,309,984 A | * | 3/1967 | MacKay | |
| 3,825,947 A | | 7/1974 | Ruben et al. | |
| 4,291,342 A | | 9/1981 | O'Conner | |
| 4,984,098 A | | 1/1991 | Buntsis | |
| 5,097,981 A | * | 3/1992 | Degasperi et al. | 221/3 |
| 5,158,521 A | * | 10/1992 | Singh | 493/354 |
| 5,452,832 A | * | 9/1995 | Niada | 225/11 |
| 5,532,680 A | | 7/1996 | Ousborne | |
| 5,671,331 A | * | 9/1997 | Croley | 221/3 X |
| 5,690,495 A | | 11/1997 | Collier | |
| 5,810,201 A | | 9/1998 | Besse et al. | |
| 6,412,655 B1 | * | 7/2002 | Stuetzel et al. | 221/13 |
| 6,419,136 B2 | * | 7/2002 | Formon et al. | 225/14 |

FOREIGN PATENT DOCUMENTS

GB 2224922 A 5/1990

* cited by examiner

*Primary Examiner*—David H. Bollinger
(74) *Attorney, Agent, or Firm*—David P. Lhota, Esq.; Stearns, Weaver, Miller, Weissler, Alhadeff & Sitterson P.A.

(57) ABSTRACT

A message delivery system for paper dispensers having a housing for dispensing paper, audible message delivery annunciator, switch mechanism, timer and speaker, wherein the annunciator stores and delivers at least one message when the switch is closed, the speaker provides an audible output of the message, the switch triggers when paper is dispensed and the timer controls the length of the message and supply of power.

18 Claims, 8 Drawing Sheets

MESSAGE DELIVERY APPARATUS AND SYSTEM FOR PAPER DISPENSERS AND SIMILAR DEVICES

CROSS REFERENCE TO RELATED APPLICATIONS

This application claims the benefit of Provisional Application Serial No. 60/181,644 filed Feb. 10, 2000.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

This invention relates generally to delivery of a message in association with activation of a sensor. More particularly, the invention relates to delivery of voice and possibly printed messages to a recipient upon usage of a common appliance. Still more particularly, the instant invention delivers an audio and possibly printed message to a recipient upon usage of a paper towel dispenser.

2. Description of the Background Art

Successful advertising campaigns require effective communication of the intended message to a targeted audience. A marketing campaign must have a consumer's attention to have a chance of success. Some devices known place advertisements at points of purchase or in other public places, but can not guarantee to get a person's attention. It is believed that audible advertisements and/or messages can be very effective if deployed in a manner or place that virtually assures consumer contact and attention, such as public restrooms and newspaper vending machines. In fact, voice messages can be enhanced by simultaneous print messages. While printed advertisements can be found anywhere, including restrooms, they are not necessarily read. One approach to more effectively reach recipients is to trigger voice messages by the use of common appliances and devices. A device and/or system that incorporate voice technology into appliances that people are sure to use would be well received.

The references found disclose several methods and/or devices that attempt to deliver messages to recipients via an audio announcer. However, none of the known devices address and resolve the foregoing as contemplated by the instant invention. For example, U.S. Pat. No. 4,291,342 discloses a talking mailbox structure and a method to play a changeable pre-recorded message when the user opens the mailbox. U.S. Pat. No. 3,825,947 discloses a device for providing a commercial announcement at a point of sale in a retail outlet or other public or semi public location. U.S. Pat. No. 4,984,098 discloses a device that provides audio advertisements at a point of purchase. U.S. Pat. No. 5,690,495 discloses a toilet training device for children that audibly announces an incentive to a child when the child pulls toilet paper from the dispenser. U.S. Pat. No. 5,810,201 discloses a device that dispenses chemicals or personal care chemicals and provides a message prompted by a push button or motion sensor. A remote sensor can detect use of a urinal, toilet or bathroom sink. U.S. Pat. No. 5,532,680 discloses an automatic message playback system that is triggered based upon a motion sensor. Upon sensing a person, a pre-recorded audio message is delivered to the individual passing by the sensor. U.K. published patent document 2,224,922A discloses a waste receptacle that delivers an audio message to the user when a micro switch closes based upon movement of the hinged flap closure of the waste receptacle.

Although several references were found for audio announcers triggered by various sensors, none of the references found disclose an audio announcer in combination and triggered by the use of a paper dispenser, such as a paper towel dispenser or newspaper vending machine, as contemplated by the instant invention. The prior art is limited to motion sensors that trigger either a message or faucet-like device. Such devices can be triggered by a person passing by without ever receiving the person's attention. Therefore, there exists a need for an audio announcer that can trigger and deliver voice messages, and possibly with a printed message, upon usage of a paper dispenser.

BRIEF SUMMARY OF THE INVENTION

In accordance with the foregoing, it is a primary object of the instant invention to provide a message delivery device and system that improves marketing and public relations effectiveness by delivering targeted audio messages to recipients when they use paper dispensers or similar dispensers.

It is another object of the instant invention to provide a message delivery device and system that delivers at least one audio message when a recipient dispenses paper from a paper dispenser.

It is still another object of the instant invention to provide a message delivery device and system that can store and play a plurality of audio messages.

It is a further object of the instant invention to provide a message delivery device and system that can alter or replace audio messages via radio frequency or hard-wired interface.

It is a still further object of the instant invention to provide a message delivery device and system that reinforces audio messages with an imprint on the paper as it is dispensed and a means to modify the imprinted message.

It is an object of the preferred embodiment of the instant invention to play audio messages upon using a paper towel dispenser.

It is an object of an alternate embodiment of the invention to deliver audio messages upon usage of a newspaper vending machine.

In light of these and other objects, the instant invention comprises a housing, a lever, an annunciator circuit with memory, a speaker and an audio message that work together to deliver audio messages to recipients upon activating the lever. The invention may also include a roller having raised letters for embossing or imprinting paper towel with messages. The external housing comprises a cover, a lever and an opening through which paper towels are dispensed from the apparatus. The cover can be opened via a hinge to reveal a roll of paper towels held in place between two end caps, one of which is attached to the lever, and an audio annunciator that delivers at least one audio message when the lever is pulled. The annunciator circuit includes a programmable chip for holding audio messages and sensors which trigger the playing of messages when paper is dispensed.

The audio annunciator comprises a sensor switch, timer, battery, microprocessor, memory, and a speaker. The sensor/switch preferably comprises magnetic contacts that come together to connect the circuit to power when the lever is depressed. The switch closes an electrical circuit that also activates a timer. The timer provides power to a microprocessor for a length of time necessary to play back one recorded message. When the microprocessor receives power, it retrieves a message digitally recorded in memory, converts it from a digital to analog signal, and passes it to a speaker so that the message may be audibly received by the person who pressed the lever.

In an alternate emodiment, the invention may imprint or emboss paper towels with messages when paper is dispensed. Upon depression of the lever by the user of the paper towel dispenser, a row of teeth on the end cap contacts a gear assembly that drives a pair of rollers. This causes the rollers to rotate and pull a segment of paper from the roll out through the opening in the dispenser. One of the rollers may have raised lettering or other indicia so that when the paper is dispensed, it is imprinted with a message that may complement the audio message. Once the paper is dispensed and the lever is released, a spring pulls the lever to its original resting position.

Another embodiment of the instant invention is adapted for a flat-sheet paper towel dispenser wherein the audio annunciator is triggered by a mechanical switch that senses when a paper towel is removed or being removed. Another embodiment of the instant invention is adapted for a newspaper vending machine whereby the audio annunciator is played when a switch is triggered by the opening of the door.

In accordance with these and other objects which will become apparent hereinafter, the instant invention will now be described with particular reference to the accompanying drawings.

DETAILED DESCRIPTION OF THE INVENTION

Figure 1:
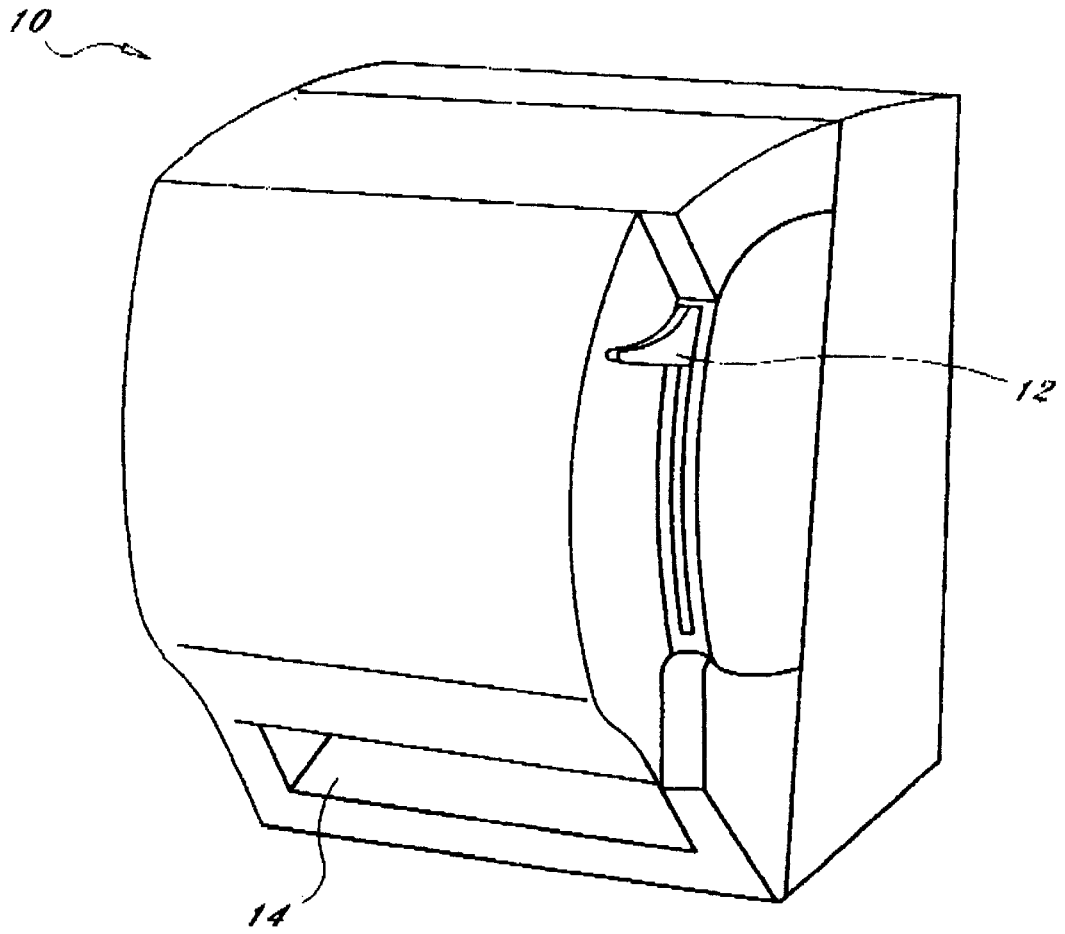
FIG. 1 is a front perspective view of instant invention with its cover closed.
Figure 2:
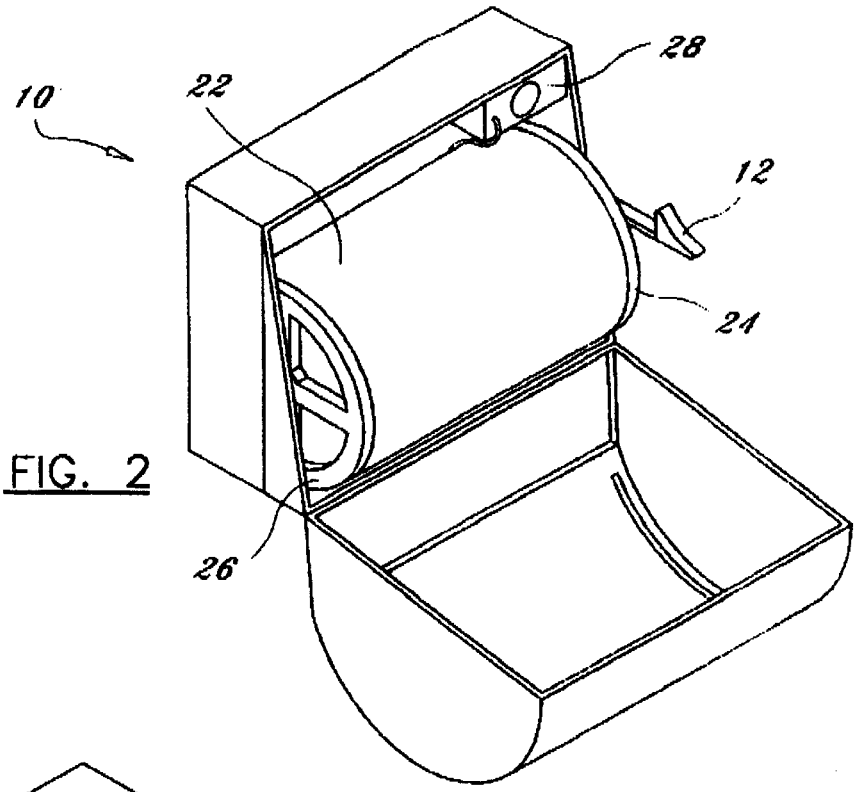
FIG. 2 is a front perspective view of the instant invention with its cover open illustrating the relationship between the paper towel and message delivery device.
Figure 3:
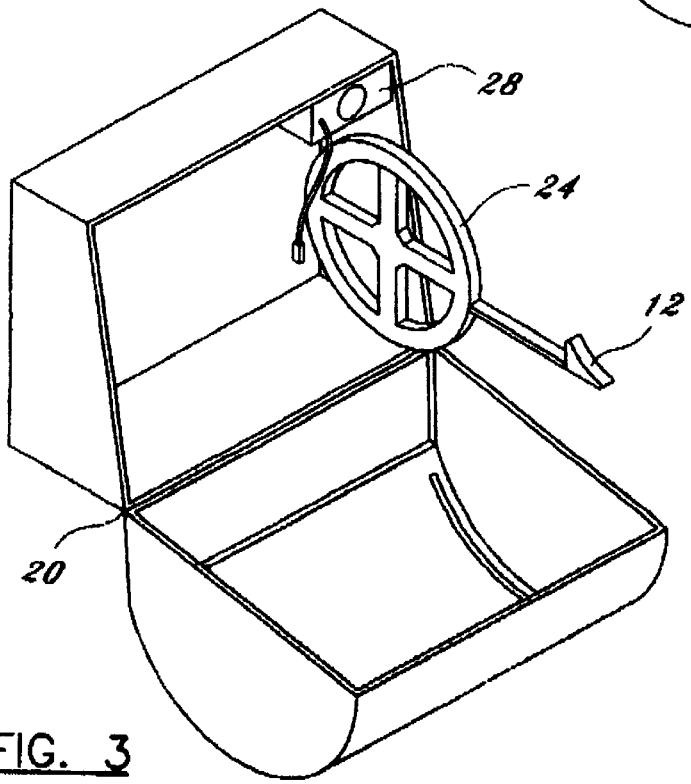
FIG. 3 is a front perspective view of the instant invention with its cover open and paper towel assembly removed to illustrate the message delivery device and system.

With reference to the drawings, FIGS. 1–9 depict the preferred and alternate embodiments of the instant invention which is referenced as a message delivery device and/or system and by numeric character 10. Referring to FIG. 1, the invention 10 comprises an external housing with a cover 3, a lever 12, and an opening 14 through which paper is dispensed from the housing 11. Referring to FIGS. 2–5, the cover 3 is pivotally secured tot he housing 11 by a hinge 20 for opening to gain access to a roll of paper towels 22 held in place between two end caps 24 and 26. The end cap 24 is attached to the lever 12. The lever 12 activates between a first position and a second position when pulled and returns to the first position when released by virtue of a spring 68 that is fixed to the housing at one end and secured to the lever chassis at the other end. When the lever 12 is pulled, paper 66 is fed through rollers 62 and 64 and switch contacts 72 and 70 are brought together. The audio annunciator 28 is secured inside the housing 11 and is electrically coupled to the switch contacts 72, 70. The rollers 62 and 64 may be adapted to place a message on the paper when the lever is pulled. The switch contacts 72, 70 come together and electrically close the annunciator circuit when the lever is pulled carrying at least one message to play.

Figure 4:
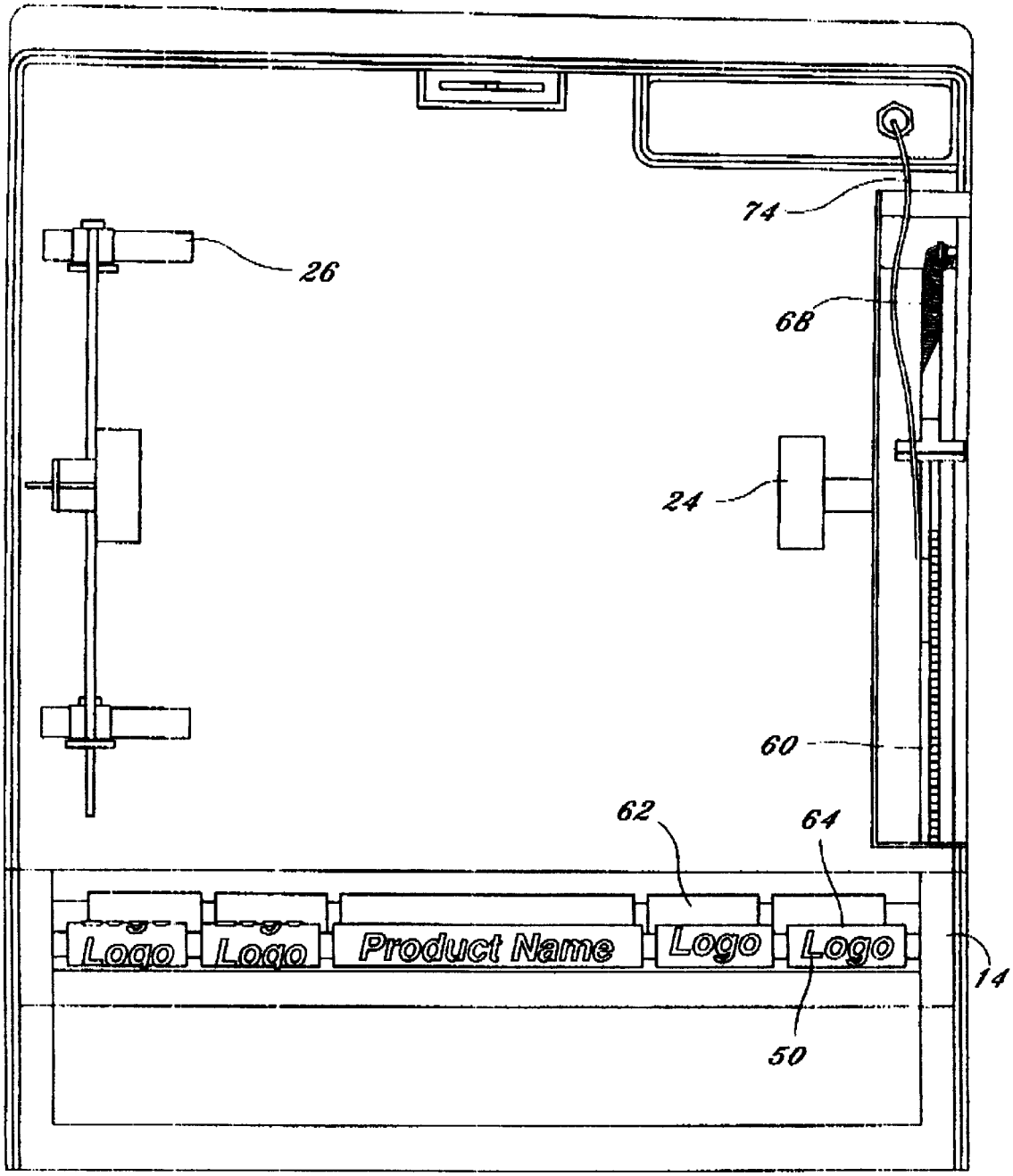
FIG. 4 is a front elevational view of the instant invention with the cover opened showing the lever, roller, paper towel, and electrical assemblies.
Figure 5:
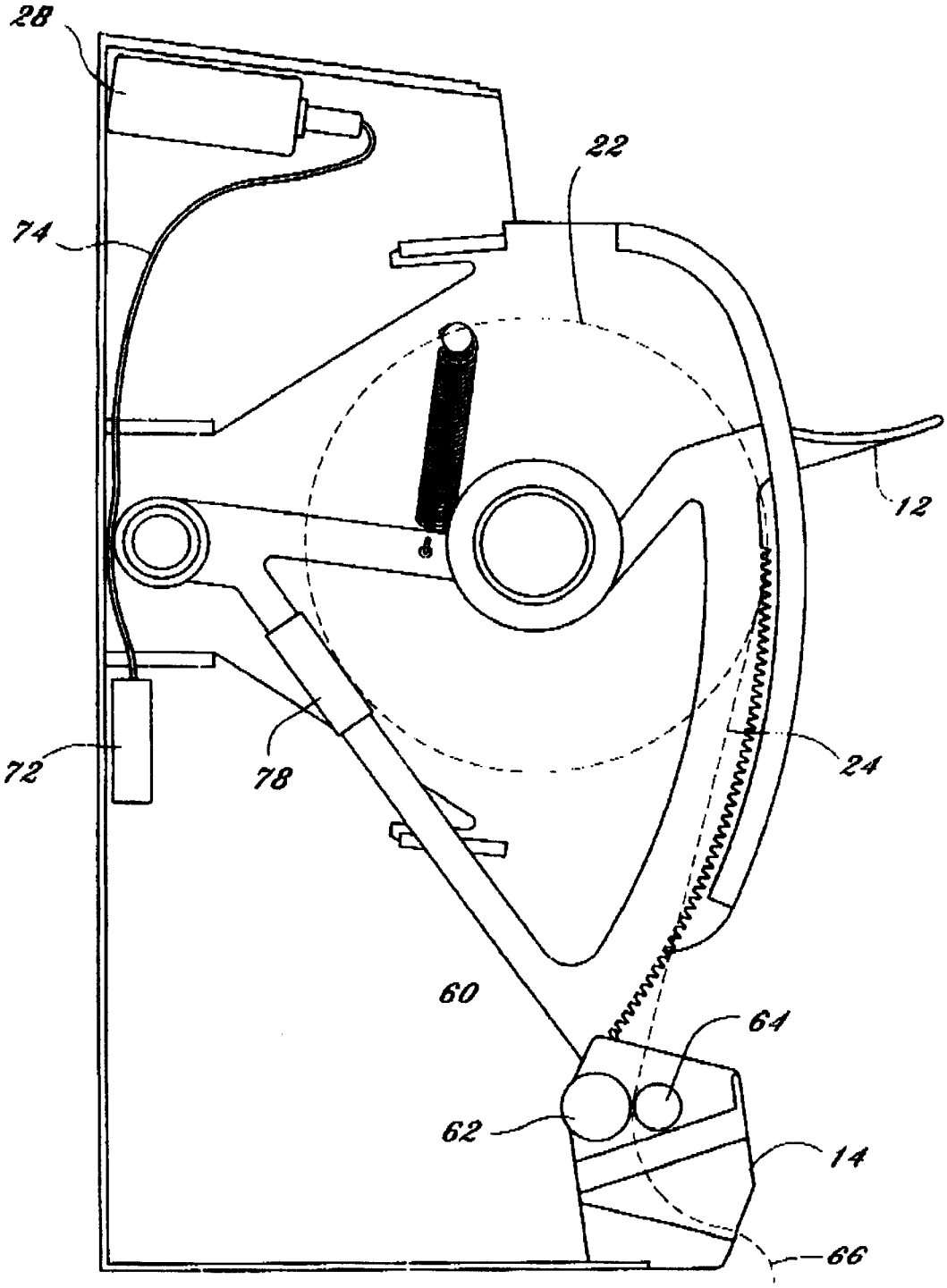
FIG. 5 is a cut away side elevational side view of the instant invention showing the lever at a first resting position and the orientation of the switch contacts.
Figure 6:
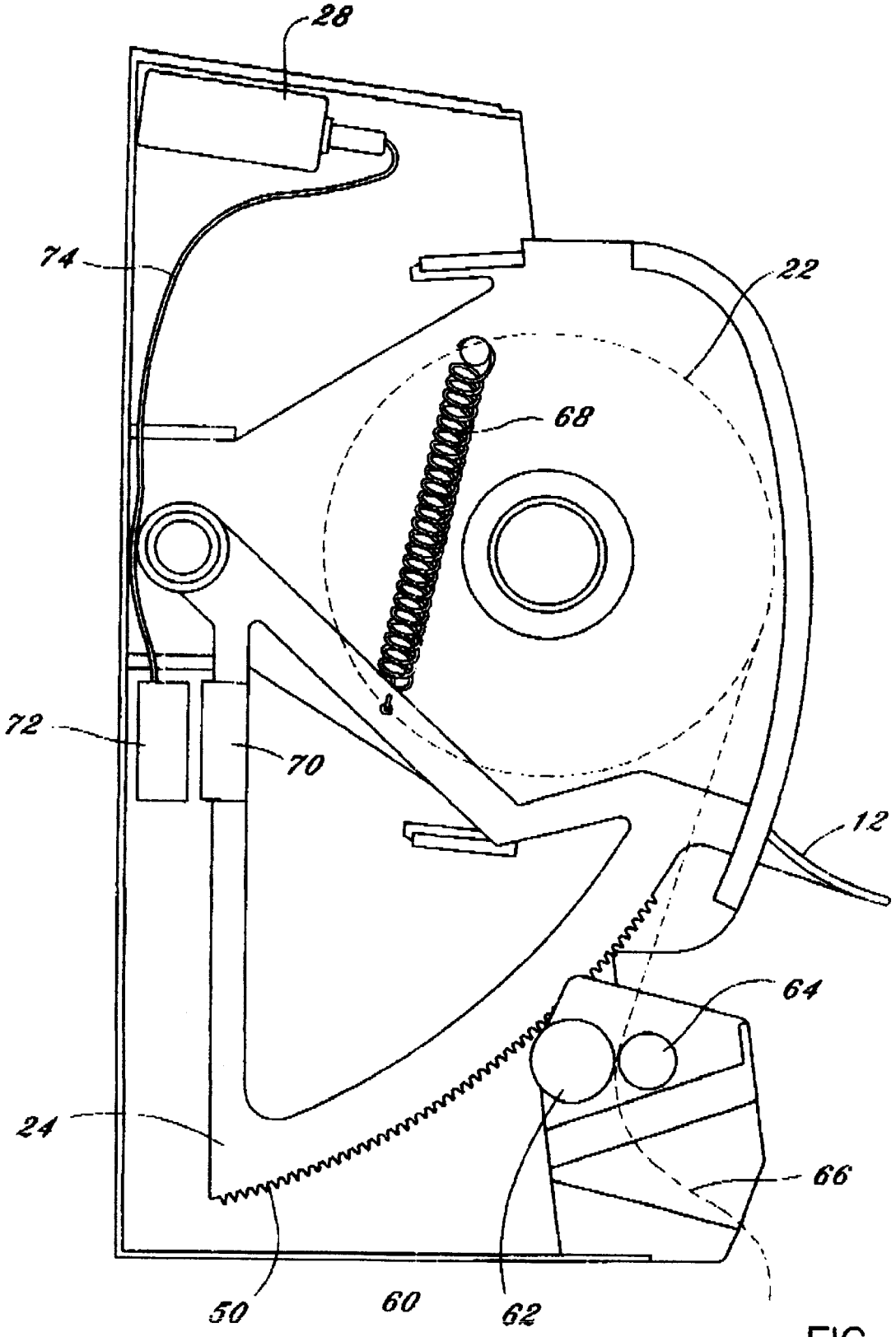
FIG. 6 is a cut away side elevational view of the instant invention showing the lever at a second depressed position and the switch contacts closed.

Referring to FIGS. 4–6, upon depression of the lever 12 by the user, a row of gear teeth 60 contact a gear assembly 60 that drives a pair of rollers 62 and 64. This causes the rollers to rotate and pull a segment of paper 66 from the roll 22 out through the opening in the dispenser 14. One of the rollers 64 may have raised lettering or other indicia 50 so that when the paper is dispensed 66, it is imprinted or embossed with a message that may complement the audio message emanating from the audio annunciator 28. Once the paper is dispensed and the lever 12 is released, a spring 68 pulls the lever to its original resting position, i.e. first position.

Figure 7:
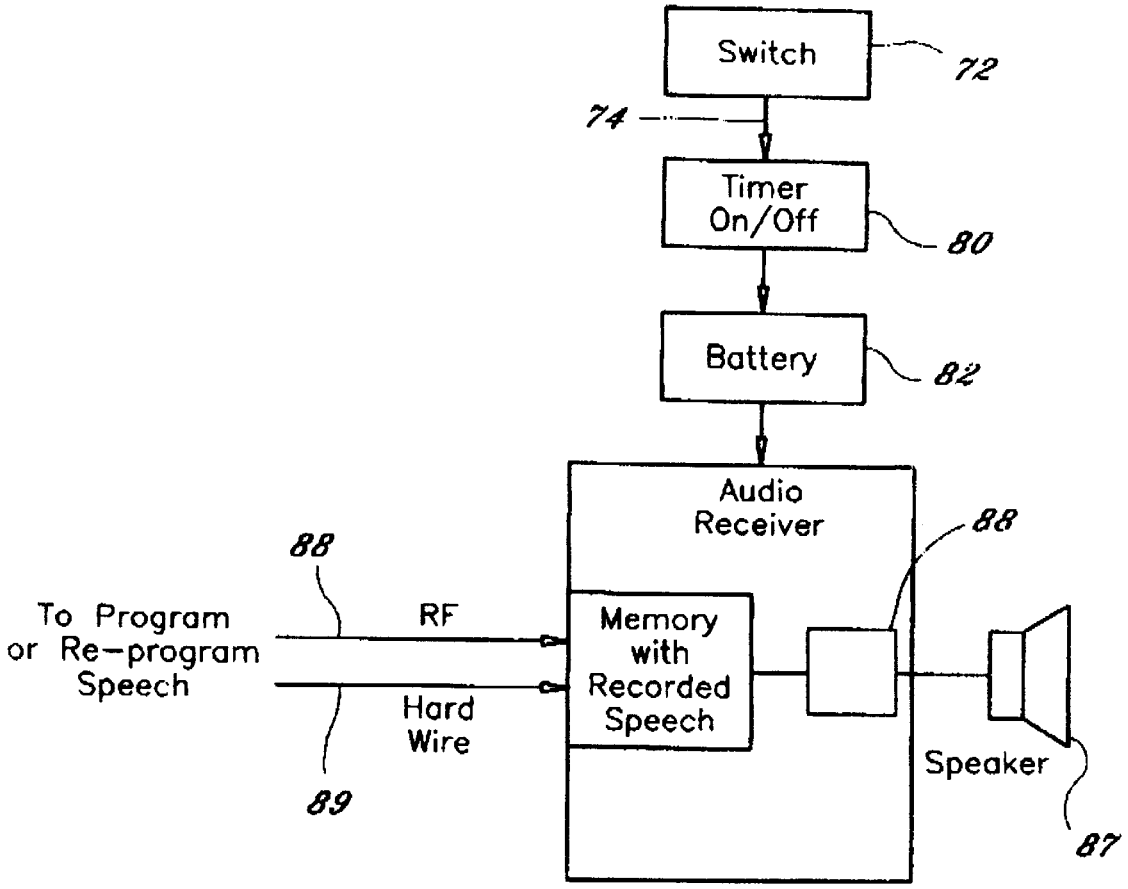
FIG. 7 is a circuit block diagram depicting the components of the audio annunciator circuit.
Figure 8:
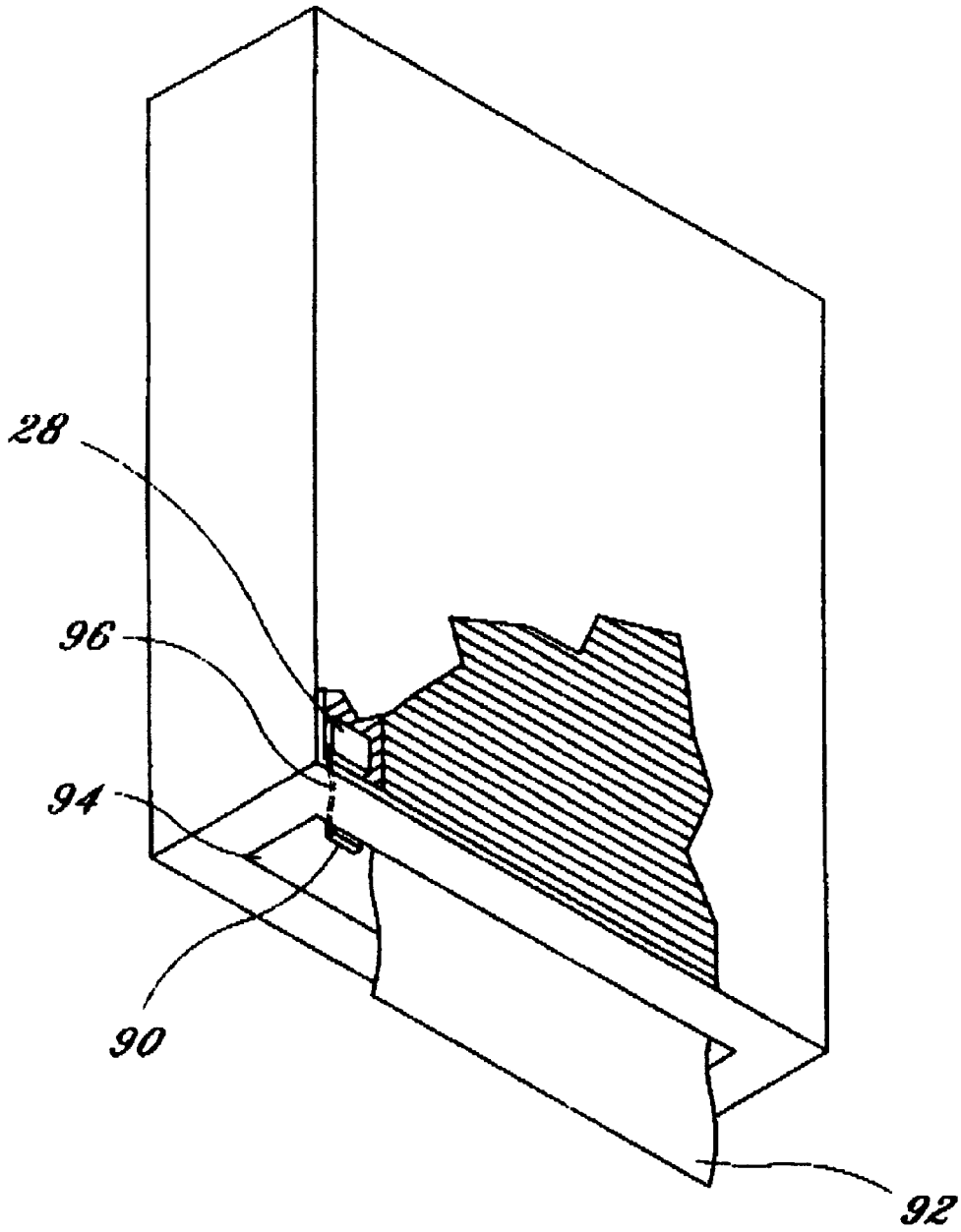
FIG. 8 is a front perspective view of an alternate embodiment of the instant invention adapted for a flat sheet paper towel dispenser.

Referring to FIGS. 5–7, a first switch contact 70 is attached to the lever chasiss on arm 12*a* so that when the lever 12 is activated, the switch contact 70 moves within close proximity to the second magnetic switch contact 72. The switch contacts 70,72 comprise magnetic contacts that create a switch and close the annunciator circuit 29 to apply power, such as battery power 82, to the annunciator 28. Other switches may be employed with the instant invention 10, such as limit switches, toggle switches and push button switches. The alternate switches must be secured in the housing 11 and to the lever chassis arm 12*a* in functional alignment. With reference to FIG. 7, the annunciator circuit 29 comprises the switch contacts 70, 72, timer (or/off) 80, battery 82 and a microprocessor based audio receiver 84 comprising memory 85 with recorded speech, D/A converter 86, RF input 88, hand wire input 89 and speaker outlet. The speaker 87 is electrically connected to the annunciator 28 and projects the recorded message. The switch 70, 72 closes the anunciator circuit 28 via a wire connection 74 to the audio annunciator unit 28 and, simultaneously, activates the timer 80. The timer 80 provides power via the battery 82 to the microprocessor 84 for a predetermined length of time necessary to play back at least one recorded message. The timer 80 reopens the circuit to remove power after the predetermined period of time and shuts itself off until it is triggered again via the lever 12 and switch 72.

When the microprocessor 84 receives power, it selects either randomly or sequentially one of the messages digitally recorded in memory 85. The microprocessor 84 then retrieves the digitally recorded message from memory 85, converts it to an analog signal via the digital-to-analog converter 88, and passes it to the speaker 87 so that the message may be audibly received by the person who pressed the lever. The set of messages digitally recorded in memory 85 may be altered or replaced via a radio frequency transmitter device or system 88 or hard-wired 89 interface. The messages may be played randomly or in sequential order.

Figure 9:
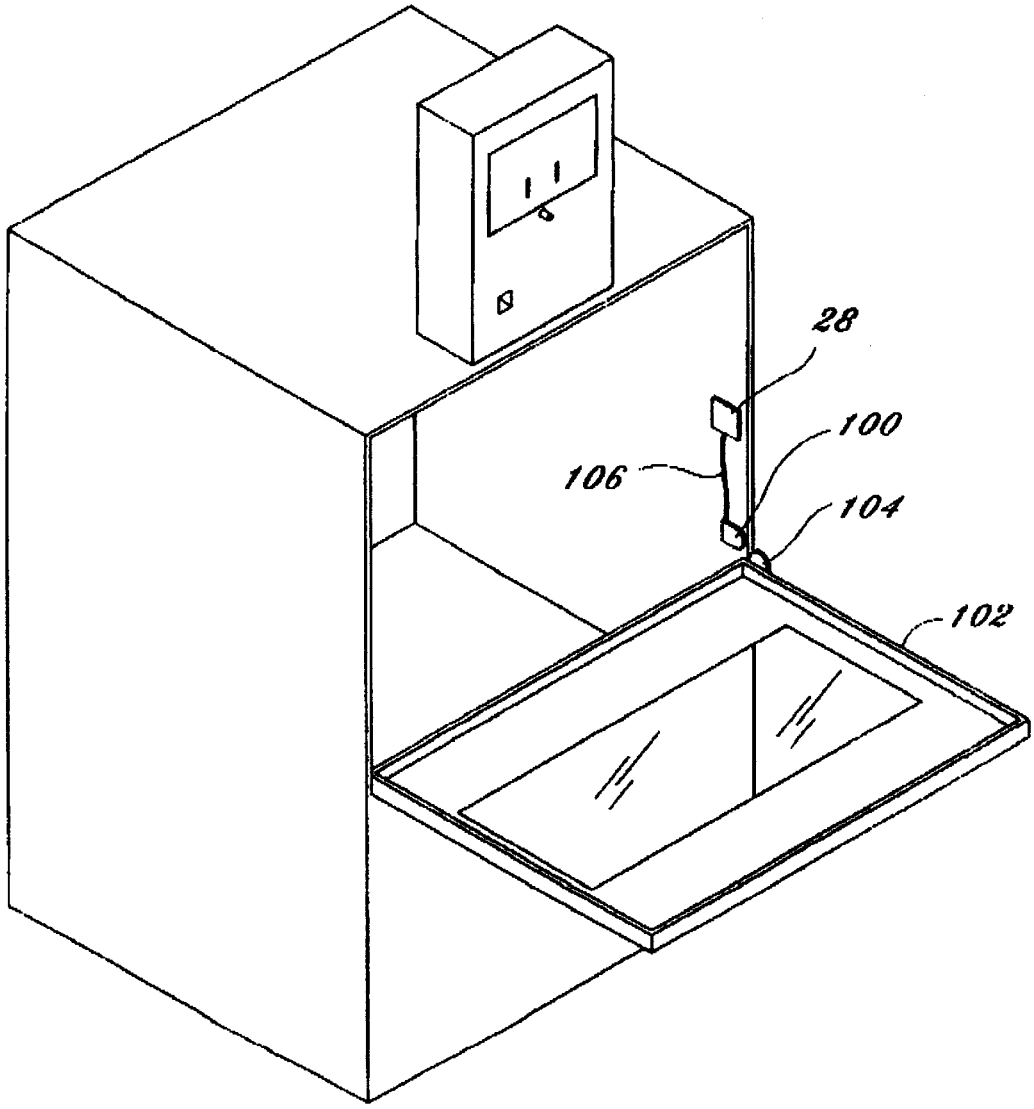
FIG. 9 is a front perspective view of an alternative embodiment of the instant invention adapted for a newspaper vending machine.

In an alternative emodiment, as shown in FIG. 9, the invention may be modified to assume the form of a flat sheet paper towel dispenser. A mechanical or infrared switch 90 senses when a user pulls a paper towel sheet 92 from the opening 94. This switch closes the annunciator circuit 29 via a wire connection 96 to an audio annunciator 28 in the form previously described. Referring to FIG. 10, another alternative embodiment could take the form of a newspaper vending machine. When a user opens the door 102 to retrieve a newspaper or other items, a first switch contact 104 is separated from a second switch contact 100, in a normally open switch relay configuration, such that a relay (not shown) such as a selenoid relay is closed connecting the battery power 82 to the microprocessor 84, as above described. This opens an electrical circuit via a wire connection 106 to an audio annunciator 28 in the form previously described. The switch employed may comprise an infrared, a mechanical switch, or a magnetic switch as previously described.

In another embodiment, the instant invention 10 may include detachable coupons on the paper or paper dispenser that are accessed when paper is removed. The coupons may be attached through perforations to the paper at the top, bottom or side, or may comprise individual sheets dispensed with the paper.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What is claimed is:

1. A paper dispenser message system comprising:

means for dispensing paper;

means for audibly delivering at least one message; and switch means for activating said message when said paper is dispensed, said switch means comprising a means for sensing when paper is dispensed from said means for dispensing paper.

2. A paper dispenser message system as recited in claim 1, wherein said dispensing means further comprises means for placing at least one message on said paper as it is dispensed.

3. A means to place messages on paper as recited in claim 2, further comprising means to imprint messages on said paper via raised lettering on at least one roller.

4. A paper dispenser message system as recited in claim 1, wherein said dispensing means comprises a housing to allow access to said message delivery means and said switch means.

5. A paper dispenser message system as recited in claim 1, wherein said switch means further comprises means for actuating when a door to said means for dispensing paper is opened.

6. A paper dispenser message system as recited in claim 1, wherein said switch means further comprises means for actuating when a lever of said means for dispensing paper is depressed.

7. A paper dispenser message system as recited in claim 1, wherein said message means comprises:

means for audible annunciation;

processing means to play back at least one message through said annunciation means; and timing means to deliver power to said processor from a power source.

8. A message means as recited in claim 7, wherein said timing means provides said power to said play back means for a duration of time at least equal to the running time of the longest message.

9. A message means as recited in claim 7, wherein said system further comprises at least one coupon dispensed by said paper dispensing means.

10. A message means as recited in claim 7, wherein said play back means further comprises means for retrieving at least one message from a storage means when said processing means receives said power.

11. A retrieval means as recited in claim 10, further comprising means to selectively retrieve said messages in random and sequential order.

12. A retrieval means as recited in claim 10, wherein said storage means further comprises means to replace, supply and modify said messages.

13. A paper dispenser message system comprising:

means for dispensing paper;

an audio annunciator for audibly delivering at least one message; and a switch for activating said message when said paper is dispensed, said switch comprising electrical contacts that come in close proximity.

14. A paper dispenser message system as recited in claim 13, wherein said dispenser further comprises raised lettering on at least one roller to imprint messages on said paper.

15. A paper dispenser message system as recited in claim 13, wherein said switch actuates when a door to said means for dispensing paper is opened.

16. A paper dispenser message system as recited in claim 13, wherein said audio annunciator comprises:

a speaker;

a processor to play back at least one message through said speaker; and a timer to deliver power to said processor from a power source.

17. A paper dispenser message system as recited in claim 16, wherein said processor further comprises a digital-to-analog converter to prepare said messages into an analog signal suitable for input to said speaker.

18. A paper dispenser message system as recited in claim 13, wherein said message may be replaced, supplied or modified via radio frequency interface.

* * * * *